United States Patent [19]

Bauer et al.

[11] Patent Number: 4,783,070

[45] Date of Patent: Nov. 8, 1988

[54] TARGET TEACHING AID

[76] Inventors: Ronald D. Bauer, 503 Robert Dr., Glenwood, Ill. 60425; Jonathan E. Voyles, 2424 S. 20th Ave., Broadview, Ill. 60153

[21] Appl. No.: 6,388

[22] Filed: Jan. 21, 1987

[51] Int. Cl.[4] ..... A63B 69/40

[52] U.S. Cl. ..... 273/26 A; 273/29 A; 273/407; 273/26 R; 124/23 R; 434/247

[58] Field of Search ..... 273/26 A, 29 A, 407

[56] References Cited

U.S. PATENT DOCUMENTS

| | | | |
|---|---|---|---|
| 708,569 | 9/1902 | Manley | 273/26 A |
| 2,978,246 | 4/1961 | Groningen | 273/26 A |
| 3,312,467 | 4/1967 | Dawson | 273/26 A |
| 3,475,026 | 10/1969 | Cooper | 273/26 R |
| 3,658,329 | 4/1972 | Ciccarello | 273/26 A |
| 4,173,337 | 11/1979 | Okonowski | 273/26 A |
| 4,188,031 | 2/1980 | Fox | 273/26 A |
| 4,473,227 | 9/1984 | Klaus | 273/26 A |
| 4,516,771 | 5/1985 | Nau | 273/26 R |
| 4,629,188 | 12/1986 | Mahieu | 273/26 A |

*Primary Examiner*—Richard C. Pinkham
*Assistant Examiner*—T. Brown
*Attorney, Agent, or Firm*—Laff, Whitesel, Conte & Saret

[57] ABSTRACT

A general purpose target for defining a window in space is provided by an F shaped frame having spaced parallel vertical ribbons extending between opposing horizontal arms of the F shape to define a strike zone. One of the ribbons may be removed to enable a bat to swing through the strike zone. The frame may be elevated when the window in space should be higher, as for an archery target, for exmaple. A colored sleeve may be disposed on each horizontal arm to define the width of the strike zone. The F shaped frame may be yieldably mounted by a spring on a support stand, or the frame may be rotatably mounted in the stand, to bend or rotate when struck by a thrown ball or swung bat.

13 Claims, 1 Drawing Sheet

TARGET TEACHING AID

This invention relates to targets and more particularly to targets for teaching athletic skills, especially for teaching skills at judging the position of an object flying through a target area in the form of a window in space.

There are many times when and places where it is desirable to provide a target for uses of the type contemplated by the invention. The type of target which the invention provides relates to areas or windows in space, as distinguished from points. For example, a baseball pitcher must throw a ball through a window in space or an imaginary vertically oriented rectangle ("the strike zone") positioned in the space above the surface of the earth and defined at least in part by the physical dimensions of a batter's body. Both the pitcher and the batter must learn to judge whether a ball flying through the air is inside or outside this window or imaginary rectangle.

Since some batters are tall and some are short, the window or imaginary rectangle may sometimes be higher above the surface of the earth than it is at other times. Thus, a target representing the strike zone must be adjustable both in size and in position.

Another example of such a target is found in archery where the arrow follows a ballistic trajectory. Thus, the archer must aim at a place in the sky in order to have the arrow fall at a certain place on the ground. While various sights may be added to a bow in order to help accomplish this end, it is also desirable for the archer to develop a skill, independent of the sight, which tells him where the arrow should be pointed when the bow is released. This time, there is also a window or an imaginary rectangle in the sky for the arrow to pass through. However, that rectangle is much higher than a baseball strike zone. Therefore, the target should be designed so that it may also be positioned a considerable distance above the earth.

Still other considerations relate to the varying needs of different users. A pitcher needs to have a full rectangle to define the entire window to pitch through. On the other hand, a batter must have an open inside edge for him to swing his bat through. If the inside edge of the window is present when the bat swings, it would knock down the target as it strikes the edge on each swing.

Yet another consideration is what happens when the moving object hits the target instead of passing through the window or imaginary rectangle. If the target is designed to give, it will merely swing to a new position when it is struck, as by a pitched ball, for example. If the target is rigidly mounted, it would soon be knocked to pieces as it is repeatedly struck.

Cost, weight, and efficiency are other considerations. The target should be light and easy to assemble so that it may be carried from a gym to a playing field, where it should be assembled and disassembled quickly and easily.

All of these and other considerations lead to the need for a very simple and low cost device.

Accordingly, an object of the invention is to provide new and improved targets of the described type. Still another object is to provide general purpose targets which may be used for many different sports.

In keeping with an aspect of this invention, a frame of pipes and connectors may be assembled into a shape which is somewhat similar to a capital letter "F", simply by slipping the ends of the rods into connectors. A section on each of the horizontal bars of the "F" shape has a colored sleeve to define the top and bottom boundries of the window or target area. The vertical boundaries are marked by removable colored ribbons which may be changed to alter or remove one of the boundaries of the target areas. The various structural elements are adjustable relative to each other in order to change the window dimensions of the target areas.

An embodiment of the invention is shown in the attached drawing, wherein.

Figure 4:
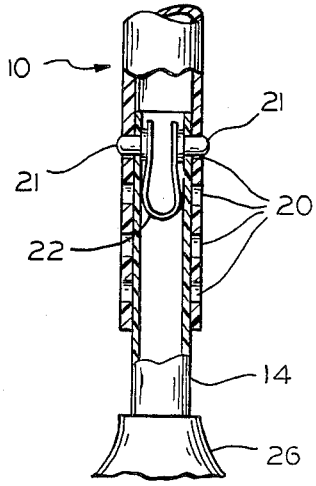
FIG. 4 shows a detent for providing an adjustment in stand height.

The inventive target stand 10 has four parts in the form of rods or pipes 12, 14, 16, 18, which may be made of any suitable material. The rods or pipes 12, 14 telescope relative to each other and are fixed in place by any suitable fastener, located at 20, and shown in detail in FIG. 4. The particular fastener shown here is in the form of a spring loaded detent 21 in pipe 14. The detent may pop out through any of a plurality of holes 20 in pipe 12 to fix the height of the target. The detent may be pushed in and then pipe 12 is slid or telescoped relative to the pipe 14. Then the detent 21 pops out the next hole.

This kind of detent (FIG. 4) is well known. Usually, there is a U-shaped spring 22 with a detent or button like member 21 projecting outwardly from near the end of one or both sides of the "U". The bight of the "U" is pressed into the end of a tubular tube 14 until the detent or button 21 pops through a hole or holes in the side wall of the tube 14. Thereafter, the detent or button is pressed down below the inside surface defining a hole 20, until the tube 12 telescopes over the tube 14 to a desired length, where the detent 21 pops through the selected hole 20.

A pair of "Tee" shaped members 23, 24 slide over the tube 12 to any suitable vertical locations, where they may be locked in place, by any suitable means. Again, a spring biased detent of the type shown in FIG. 4 may be used to lock the "T" members in place at any suitable height above the floor or ground. The ends of rods or pipes 16, 18 are pressed into the stem of the "T" members 22, 24 in order to form the horizontal arms of the "F" shaped stand. If desired, the rods or pipes may be configured to lock into place by being given a quarter turn.

Any suitable material may be used to make the rods or pipes and the "T" members 12–24. However, one readily available, low cost material which gives excellent results is rigid plastic pipes which are found among the plumbing supplies in most hardware stores, lumber yards or the like. These pipes are often used as water pipes in home construction.

The bottom of the lower pipe or rod 14 fits into or swings about a socket in a base or weight 26. Preferably the socket and pipe or rod have a sliding, friction fit so that the entire frame 10 is held in a stable upright position and yet is free to rotate or swivel about its vertical axis, if it is struck by a ball or bat. Again, a base or weight of this type is readily available and is used to hold many things ranging from flag poles to stanchions or posts which may be used to hold crowd control cords or ropes.

Figure 3:
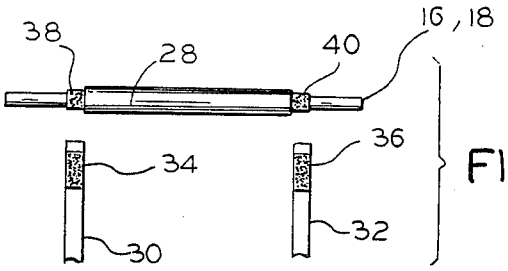
FIG. 3 is a showing of a detail relating to one method of attaching the horizontal boundary and the vertical ribbons.

As best seen in FIG. 3, each of the, horizontal pipes or rods 16, 18 has a marker in the form of a colored sleeve 28 which is as wide as a desired the horizontal edges of the target area. If the pipes and T parts 12–24 are a light cream or gray color, the sleeve 28 may be bright red, yellow, or orange, for example. In one case, the sleeve 28 may be a plastic member which slips over the end of the pipes or rods 16, 18. In another case, the sleeve 28 may be a colored masking or adhesive tape which is adhered to and around the periphry of the pipes or rods 16, 18. Of course, any other suitable means may also be used to apply the target boundary marking which define the horizontal edges of the window of space or target area. For example, a length of the pipes or rods 16, 18 may be spray painted to fix the target area. Normally, a tape or plastic sleeve is preferred so that the length of the target area may be changed quickly and easily.

Any suitable fastening means 34, 36, 38, 40, may be used to attach the vertical boundary markers 30, 32 to the horizontal bars 16, 18 and thereby form the vertical edges of the window of space which defines the target area. These bqundry markers may be any sturdy ribbon material. Depending upon target needs, it may also be a bright color, such as red, yellow, or orange.

In a preferred embodiment, "Velcro" hook and loop fastener material 38, 40 is applied to the ends of the pipes or rods 16, 18, adjacent the sleeve 28. The cooperating fastening material 34, 36 may be attached to the opposite ends of the ribbons 30, 32. Thus, the vertical markers may be attached to the horizontal bars 16, 18 simply by wrapping the ends of the ribbons 30, 32 around the bars 16, 18. If the target area is to have an increased vertical height, the "T" members 22, 24 are slid up or down and the ribbons 30, 32 may be made longer. If the target area is to be made shorter, the reverse occurs.

Figure 1:
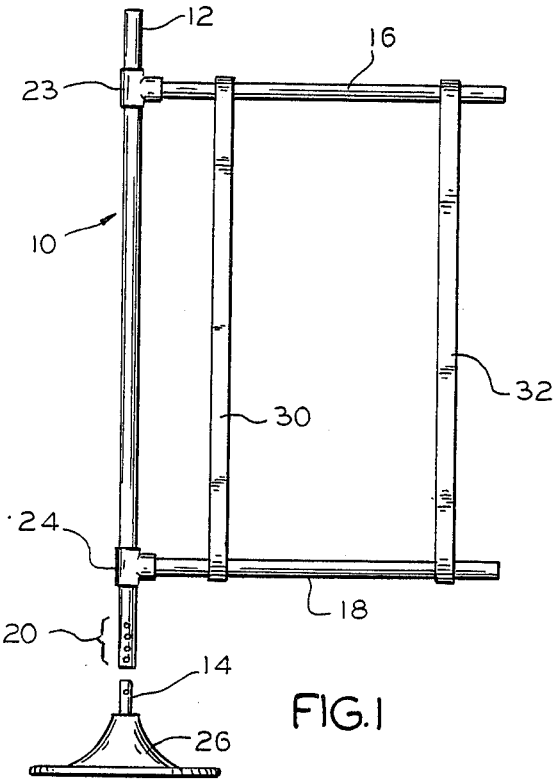
FIG. 1 is an elevation view of the inventive target.
Figure 2:
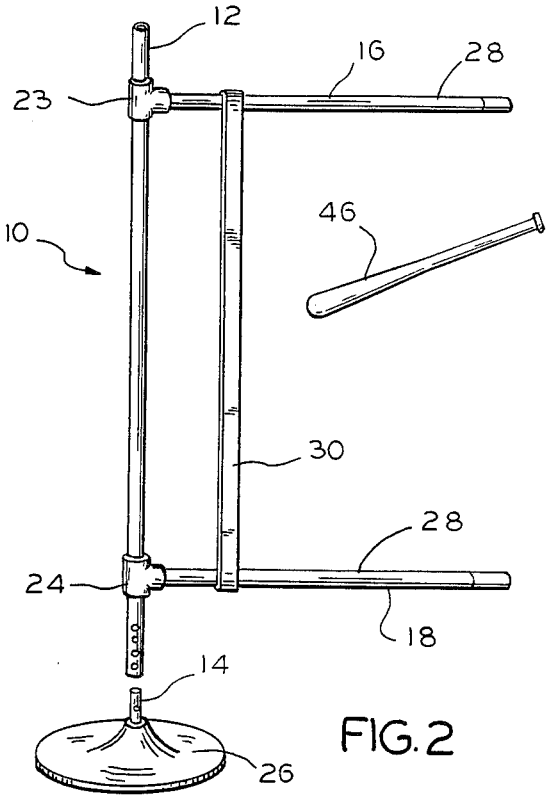
FIG. 2 is a view similar to that of FIG. 1, except that one of the vertical ribbons is removed to enable a bat to pass through the inside edge of the target area.

An advantage of this arrangement is that a baseball pitcher, for example, may be given a complete window of space defining a rectangular strike zone to pitch through, as shown in FIG. 1. If the side ribbon 32 is removed a baseball bat 46 may be swung into the strike zone, as shown in FIG. 2. Hence, the same target may be used to familiarize both the pitcher and the batter with the boundries of the strike zone.

If the batter is left-handed, for example, the "F" frame 10 is simply rotated within the socket in base or weight 26. The frame arms 16, 18 then project to the left, instead of to the right as viewed in FIG. 2.

Figure 5:
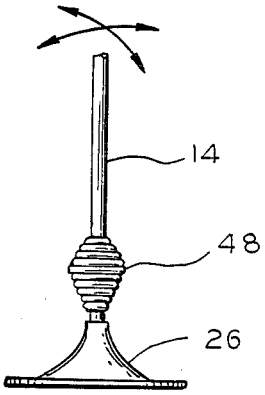
FIG. 5 shows a device for absorbing a blow, as where a ball or bat strikes the target stand.

In the embodiment of FIG. 5, the pipe or rod 14 is secured to the base or weight 26 by a heavy coiled spring 48 so that the vertical member 14 may whip back and forth if it is struck, as by a ball or bat, for example.

Figure 6:
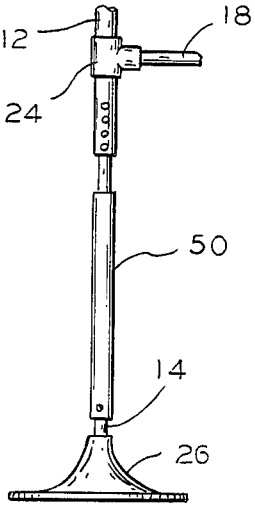
FIG. 6 shows an elongation which may be used to raise the target zone.

If it is desirable to elevate or raise the window of space that defines the target area by a substantial distance, an extra section of pipe or rod 50 (FIG. 6.) may be inserted between the telescoping sections 12, 14. With the target area so raised, there is a window of space in the sky, through which an arrow, for example, may be shot so that it will follow a ballistic trajectory toward a target. In a similar manner, the target may be located at any suitable height above the ground.

Those who are skilled in the art will readily perceive how to modify the system. Therefore, the appended claims are to be construed to cover all equivalent structures which fall within the true scope and spirit of the invention.

I claim:

1. A baseball pitcher's practice target comprising a frame having at least one vertical and two horizontal frame members joined together to form the frame in an F shape, a pair of spaced parallel vertical boundary marker means extending between the horizontal frame members in said F shape whereby the target is defined by a window of space within the area between the horizontal frame members and the vertical marker means, means for marking a limited distance along the length of said horizontal frame members to fix and define the width between said vertical boundary marker means of said window of space forming said target area and means for supporting said target on a support surface

2. The target of claim 1 wherein said vertical frame member telescopes so that the distance between said horizontal frame members and a support surface may be varied.

3. The target of claim 1 wherein said horizontal frame members are vertically movable to selected positions along the length of said vertical frame member to enable an adjustment of the vertical area of said window of space.

4. The target of claim 1 and means for enabling said frame to move freely if struck.

5. The target of claim 1 and means for elevating the F-shaped frame whereby said window of space may be vertically adjustable relative to a support surface.

6. A baseball target comprising four markers, a frame of at least one vertical and two horizontal structural frame members arranged in an F shape and having two side markers attached between said horizontal members of said F-shape, means comprising the other two markers for marking lengths along the upper and lower horizontal members for defining top and bottom boundaries of said strike zone, said four markers defining four boundary sides of a pitcher's target for a strike zone, means for adjusting the positions of at least two of said markers to redefine the vertical dimension of said strike zone for matching the strike zone dimensions for different batters, at least being detachable one of said side markers while retaining the other three markers in order to define an area through which a batter may pass his bat and means for supporting said target on a support surface

7. The target of claim 6 wherein at least one of said other two markers is a sleeve slipped over one of said horizontal members.

8. The target of claim 6 wherein said at least one marker is a tape adhered to said one horizontal member.

9. The target of claim 6 wherein each of said horizontal members has fastener means on each end of said marked length, and ribbon means having fasteners for releasably attaching said at least one of said side markers to said horizontal frame members.

10. The target of claim 9 wherein said fastener means is a hook and loop fastener means.

11. The target of claim 6 and means for absorbing blows to said frame in order to reduce damage from pitched balls or swing bats which strike said frame.

12. The target of claim 11 wherein said support means is a base for supporting said frame and said absorbing means comprises a swivel connection between said frame and said base for supporting said frame.

13. The target of claim 11 wherein said support means is a base for supporting said frame, and said absorbing means comprises a spring interconnecting said frame and base.

* * * * *